United States Patent [19]

Bost

[11] Patent Number: 4,726,264

[45] Date of Patent: Feb. 23, 1988

[54] STOPPER REMOVAL APPARATUS

[76] Inventor: Charles H. Bost, 1520 Eckert Dr., Winter Haven, Fla. 32881

[21] Appl. No.: 61,727

[22] Filed: Jun. 15, 1987

[51] Int. Cl.[4] ..... B67B 7/02

[52] U.S. Cl. ..... 81/3.4; 81/3.09

[58] Field of Search ..... 81/3.07, 3.4, 3.29, 81/3.42, 3.09; 7/151

[56] References Cited

U.S. PATENT DOCUMENTS

| | | | |
|---|---|---|---|
| 2,985,044 | 5/1961 | Gill | 81/3.4 |
| 3,048,067 | 8/1962 | Miles et al. | 81/3.4 |
| 3,186,263 | 6/1965 | Grote | 81/3.4 |
| 3,812,741 | 5/1974 | Heine | 81/3.4 |
| 3,919,901 | 11/1975 | Braman | 81/3.4 |
| 4,522,089 | 6/1985 | Alvi | 81/3.42 |

*Primary Examiner*—Roscoe V. Parker

*Attorney, Agent, or Firm*—William M. Hobby

[57] ABSTRACT

A stopper removal apparatus is provided having an elongated flexible hollow stopper removal member for removing a stopper form a medical container and having an open end and a closed end, the stopper removal member has an angled protective shield adapted to extend over a medical container stopper and to cover a portion of the medical container. A first flexible stopper gripping portion of the stopper removal member is connected to the angled protective shield and can be compressed onto the stopper for removing the stopper. A second flexible stopper gripping portion is smaller in size than the first stopper gripping portion and is connected to the first stopper gripping portion for gripping and removing a smaller stopper from medical containers, so that a person can remove a plurality of sizes of stoppers from medical containers with one size shielded stopper removal apparatus while being shielded from the contents of the medical container.

10 Claims, 6 Drawing Figures

STOPPER REMOVAL APPARATUS

BACKGROUND OF THE INVENTION

The present invention relates to a stopper removal apparatus and especially to a stopper removal apparatus, which shields a person from the contents of a medical container while the person is removing the stopper.

In the past, a wide variety of medical container have been provided with various types of caps, such as screw caps and lids and various types of stoppers. Typically, containers for holding specimens to be analyzed, such as blood and urine samples, are kept in simple medical vials having rubber stoppers attached thereto and labeled to identify the specimen. Specimen are taken in doctors offices and in hospitals labeled and sent to a pathology or testing lab for analyzing for various types of medical conditions. Personnel in labs and hospitals have become more concerned about the handling of specimen containers especially in the insertion and removal of the stoppers into vial types of medical containers. The present invention is directed towards preventing any contact with a patient specimen in the insertion and removal of rubber stoppers into medical containers and especially into vials.

SUMMARY OF THE INVENTION

The present invention relates to a stopper removal apparatus having an elongated flexible hollow stopper removal member for removal of a stopper for a medical container. The stopper removal member has an open end and a closed end and has an angled protective shield adapted to extend over the medical container stopper and to cover a portion of the medical container. The protective shield has an open end forming the open end of the elongated flexible hollow stopper removal member. A first flexible stopper gripping portion of the elongated flexible hollow stopper removal member is used for gripping a stopper on a medical container and is connected to the other end of the angled protective shield. The flexible stopper gripping portion has a first diameter for gripping at least one size medical container stopper. A second flexible stopper gripping portion of the stopper removal member is used for gripping a stopper of a smaller size than the first flexible stopper gripping portion and is connected to the first flexible stopper gripping portion so that a person may remove a plurality of sizes of stoppers from medical containers while being shielded from the contents of the medical container. The elongated flexible hollow stopper removal portion is an angled protective shield in the shape of a hollow truncated cone. Each of the elongated flexible hollow stopper removal portions has an internal gripping surfaced formed with axially extending ridges for gripping the stopper and the exterior surface for the first flexible stopper gripping portion has exterior knurled surface formed thereon for a better grip by the user. The stopper removal member may be a one piece injected molded polymer.

BRIEF DESCRIPTION OF THE DRAWINGS

Other objects features and advantages of the present invention will be apparent from the written description and the drawings in which.

THE DESCRIPTION OF THE PREFERRED EMBODIMENT

Figure 1:
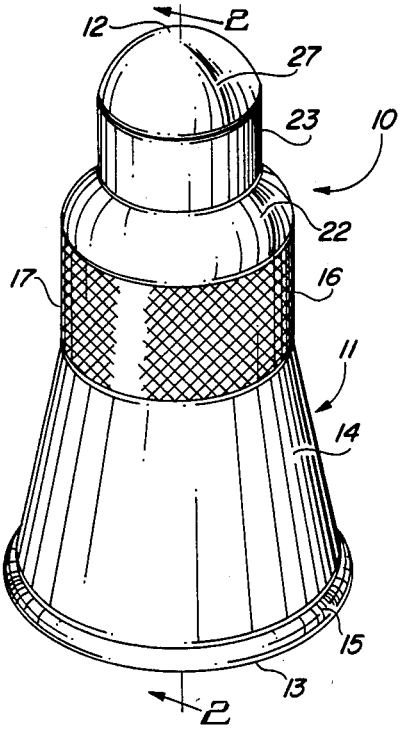
FIG. 1 is a perspective view of a stopper removal apparatus in accordance with the present invention.
Figure 2:
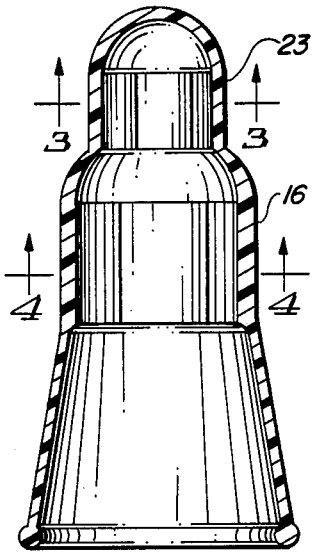
FIG. 2 is a sectional view taken on line 2—2 of FIG. 1.
Figure 3:
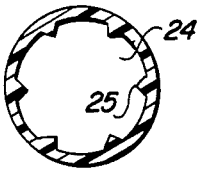
FIG. 3 is a sectional view taken on line 3—3 of FIG. 2.
Figure 4:
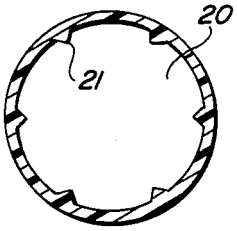
FIG. 4 is a sectional view taken on line 4—4 of FIG. 3.
Figure 5:
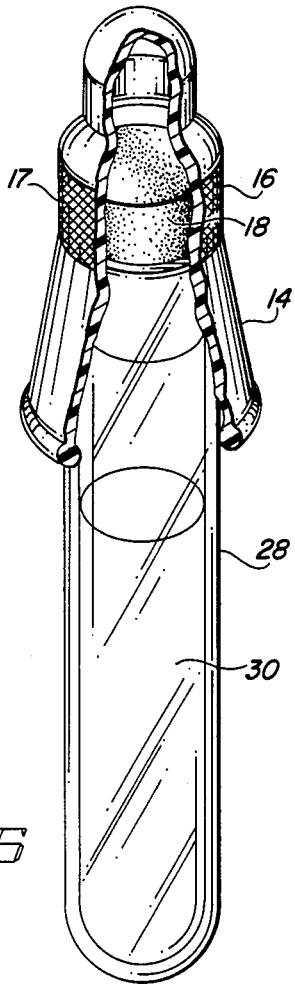
FIG. 5 is a cutaway perspective view of a stopper removal apparatus in accordance with FIGS. 1 through 4 placed over a stopper on a medical container.
Figure 6:
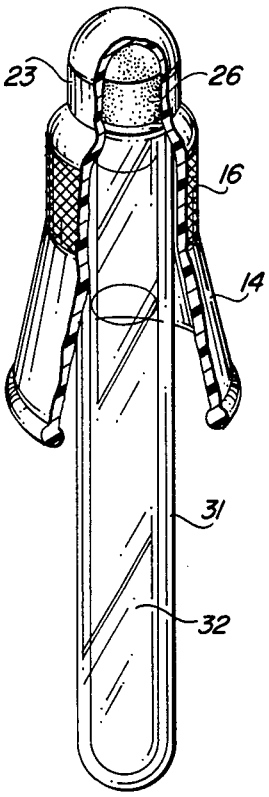
FIG. 6 is a cutaway perspective view of the stopper removal apparatus in accordance with FIGS. 1 through 5 placed on a different size medical container.

Referring to FIGS. 1 through 6 of the drawings, a stopper removal apparatus 10 is illustrated having an elongated flexible hollow stopper removal body 11 having a sealed top end 12 and an open end 13. An angled protective shield portion 14 has the general shape of a hollow truncated cone with an annular lip 15 going around the open end thereof. The shield portion 14 is connected to a first flexible stopper gripping portion 16 having a knurled outer surface 17 for gripping the surface and squeezing it against the stopper 18. As seen in FIG. 5, the internal portion of the first flexible stopper gripping portion 16 is a hollow cylindrical portion 20 having a plurality of axially extending ridges 21 having a generally triangular crosssection for use in gripping the stopper 18. The first flexible stopper gripping portion 16 has an angular arcuate surface 22 connecting one end of the gripping portions 16 to a second flexible stopper gripping portion 23 which is also of a generally cylindrical shape and has a hollow interior forming a cavity 24 have a plurality of axially elongated ridges 25 there inside for gripping a stopper 26, as shown in FIG. 6, of a smaller size than the stopper 18 which is gripped by the first gripping portion 16. The second flexible stopper gripping portion 23 is connected at one end to the angular arcuate connecting portion 22 and at the other end to a flexible dome 27. The entire unit can be an injection molded polymer, such as, molded in one piece.

In operation the stopper removal apparatus is slipped over a stopper 18 of a vial 28 filled with a specimen 30 and the first flexible stopper gripping portion 16 is squeezed and compressed against the stopper 18 in the vial 28. Once it is gripped by pushing the fingers against the knurled surface 17, the stopper is easily removed from the vial 28 while the shielding portion 14 extends over the top portion of the vial 28 to capture any splatter as the stopper is removed. Stopper removal apparatus 10 may also be used for inserting the stopper 18 for smaller vials, such as 31 in FIG. 6, filled with a specimen or any contaminated liquid 32. The stopper removal apparatus 10 is pushed over the stopper 26 with the shield 14 and the first flexible stopper gripping portion 16 extending over the top portion of the vial 31. The second flexible stopper gripping portion 23 can then be grasped by the hand and compressed against the stopper 26, to pull the stopper from the vial 31. The stopper removal apparatus 10 is a throw away item so that the stopper and the stopper removal apparatus can be then be thrown away, or alternatively, the stopper removal apparatus 10, can hold the stopper while some of the specimen 30 or 32 in vial 28 or 31 is removed and the stopper placed back on the vials when finished the stopper removal apparatus 10 with or without the stopper can be be thrown away. The lab technicians or doctors hands are thus able to avoid all contact with specimens or contaminated liquids in the medical containers during the handling of the medical containers in the insertion and removal of the stoppers in the performance of tests. However the present invention is not to be construed as limited to the forms shown which are to be considered illustrative rather than restricted.

I claim:

1. A stopper removal apparatus comprising:

an elongated flexible hollow stopper removal means for removal of a stopper from a medical container and having an open end and a closed end, said elongated flexible hollow stopper removal means having:

an angled protective shield adapted to extend over a medical container stopper and to cover a portion of the medical container, said protective shield having an open end forming the open end of said elongated flexible hollow stopper removal means;

a first flexible stopper gripping means for gripping a stopper on a medical container and being connected to the other end of said angled protective shield, said first flexible stopper gripping means having a first diameter for gripping at least one size medical container stopper;

a second flexible stopper gripping means for gripping a stopper of a smaller size than said first flexible stopper gripping means and connected to said first flexible stopper gripping means; whereby a person may remove a plurality of size stoppers from medical containers with the one size shielded stopper removal apparatus while being shielded from the contents of the medical container.

2. A stopper removal apparatus in accordance with claim 1 in which said elongated flexible hollow stopper removal means closed end is connected to said second flexible stopper gripping means to shield the top of said elongated flexible hollow stopper removal means.

3. A stopper removal apparatus in accordance with claim 2 in which said elongated flexible hollow stopper removal means angled protective shield forms a truncated cone shape having one end open and the other end connected to the first flexible stopper removal means.

4. A stopper removal apparatus in accordance with claim 3 in which said elongated flexible hollow stopper removal means first flexible stopper gripping means has gripping ribs formed therein to grip a stopper when the flexible sides are compressed against the stopper.

5. A stopper removal apparatus in accordance with claim 4 in which said elongated flexible hollow stopper removal means second flexible stopper gripping means has gripping ribs formed therein to grip a stopper when the flexible sides are compressed against the stopper.

6. A stopper removal apparatus in accordance with claim 5 in which said elongated flexible hollow stopper removal means first flexible stopper gripping means has exterior knurling formed thereon for a user to grip when when removing a stopper from a medical container.

7. A stopper removal apparatus in accordance with claim 6 in which elongated flexible hollow stopper removal means angled protective shield is longer than said first flexible stopper gripping means.

8. A stopper removal apparatus in accordance with claim 7 in which said elongated flexible hollow stopper removal means first flexible stopper gripping means gripping ribs are axially extending ridges formed therein to grip a stopper when the flexible sides are compressed against the stopper.

9. A stopper removal apparatus in accordance with claim 8 in which said elongated flexible hollow stopper removal means second flexible stopper gripping means gripping ribs are axially extending ridges formed therein to grip a stopper when the flexible sides are compressed against the stopper.

10. A stopper removal apparatus in accordance with claim 9 in which elongated flexible hollow stopper removal means is made of a polymer material.

* * * * *